United States Patent [19]

Dzhaparidze et al.

[11] 4,069,116

[45] Jan. 17, 1978

[54] ELECTROCHEMICAL PROCESS FOR PRODUCING MANGANESE DIOXIDE

[76] Inventors: Levan Nikolaevich Dzhaparidze, ulitsa Saburtalinskaya, 37, kv. 9; Temuri Alexandrovich Chakhunashvili, ulitsa Plekhanova, 2/8; Venera Romanovna Mainsuradze, prospekt Akakiya Tsereteli, korpus 5, kv. 54; Raul Vladimirovich Chagunava, ulitsa Pekinskaya, 2, kv. 23, all of Tbilisi; Zurab Yasonovich Kervalishvili, prospekt Lenina, 14, kv. 3; Nodar Georgievich Sikharulidze, ulitsa Saradzhishvili, 51, kv. 24, both of Rustavi; Dali Georgievna Otiashvili, prospekt V. Pshavela, 11, kv. 12, Tbilisi; Yauzhe Markovich Dubov, Odintsovo, poselok Bakovka, ulitsa Vokzalnaya, 30, Moskovskaya oblast; Eduard Alimovich Bogdanov, tupik Tsulukidze, korpus 2, kv. 10, Tbilisi; Georgy Trofimovich Gogoladze, ulitsa Chavchavadze, 6, kv. 44, Rustavi; Alla Abelevna Teisheva, ulitsa Panfilova, 10, kv. 40, Moscow; Galina Nikolaevna Ryzygraeva, ulitsa Festivalnaya, 65, kv. 706, Moscow; Mikhail Alexeevich Melnikov-Eikhenvald, ulitsa Vavilova, 12, kv. 18, Moscow; Temuri Valeryanovich Rokva, ulitsa Megrelidze, 16, Tbilisi, all of U.S.S.R.

[21] Appl. No.: 798,097

[22] Filed: May 18, 1977

[51] Int. Cl.[2] ..... C25B 1/00

[52] U.S. Cl. ..... 204/96

[58] Field of Search ..... 204/96

[56] References Cited

U.S. PATENT DOCUMENTS 3,436,323 4/1969 Shimizu et al. ..... 204/96

*Primary Examiner*—R. L. Andrews

*Attorney, Agent, or Firm*—Steinberg & Blake

[57] ABSTRACT

Disclosure is made of an electrochemical process for producing manganese dioxide by electrolyzing a solution containing 100 to 200 g/l of manganese sulphate and 20 to 100 g/l of sulphuric acid. The temperature of the solution is 90° to 98° C, and the anode current density is 100 to 300 A/m$^2$. The anode is of titanium. On the surface of the anode there are provided uniformly spaced hollows whose total surface area is not less than 10 percent of that of the anode. Inside said hollows there is provided a coating consisting of two layers. The first layer is 0.8 to 5 mu thick and is of a metal selected from the platinum family; it may be of ruthenium dioxide or platinum oxide. It also may be of lead dioxide, in which case this first layer is 0.1 to 1 mm thick. The second layer has a thickness of 1 to 2 mm and is of manganese dioxide. The cathode is of chromium-nickel steel containing 18 to 23 mass percent of chromium, 20 to 28 mass percent of nickel, and alloy additions, including copper, molybdenum, titanium, silicon and manganese.

The proposed process yields manganese dioxide which is used as paste of positive electrodes of manganese-zinc voltaic cells.

6 Claims, No Drawings

ELECTROCHEMICAL PROCESS FOR PRODUCING MANGANESE DIOXIDE

The present invention relates to electrochemistry and, more particularly, to an electrochemical process for producing manganese dioxide.

Manganese dioxide produced in accordance with the proposed process is used as paste of positive electrodes of manganese-zinc voltaic cells.

There are widely known electrochemical processes for producing manganese dioxide by electrolyzing a solution of manganese sulphate with the use of lead and graphite anodes and cathodes.

Such methods have a number of disadvantages. First, the anode is disposable. Second, the anode and cathode possess low mechanical strength. Third, the end product is contaminated with the electrode material.

There are also known processes for producing manganese dioxide, whereby electrolysis is carried out at anode current densities not higher than 50 to 100 A/m$^2$. In such processes, use is made of sandblasted titanium anodes and lead or graphite cathodes (cf. M. L. Fioshin, Uspekhi v oblasti electrosynteza neorganicheskikh soyedineny /"Improvements in the Electrosynthesis of Inorganic Compounds"/, p.112, Chimia Publishers, Moscow, 1974). Such processes are disadvantageous in a low specific duty of electrolyzers due to the low anode current density; another disadvantage is the large size of the electrolyzers.

There is still further known a process for producing manganese dioxide, whereby electrolysis is carried out with the use of titanium anodes fully coated with layers of metals selected from the platinum family (cf. Czechoslovak Pat. No. 108,776).

The latter process is disadvantageous because of its high cost and great losses of noble metals in the course of the removal of the manganese dioxide deposit from the anodes.

It is an object of the present invention to provide for more frugal use of metals of the platinum family.

It is another object of the invention to prolong the life of anodes.

It is still another object of the invention to raise the mechanical strength of cathodes.

The foregoing objects are attained by providing an electrochemical process for producing manganese dioxide by electrolyzing a solution containing 100 to 200 g/l of manganese sulphate and 20 to 100 g/l of sulphuric acid, the temperature of the solution being 90° to 98° C, and the anode current density being 100 to 300 A/m$^2$, the process being carried out with the use of a titanium anode and cathode, the anode surface having a coating to prevent passivation of the anode, which process is characterized in that according to the invention, the anode surface is provided with uniformly spaced hollows whose total surface area is not less than 10 percent of that of the anode, whereas inside said hollows there is provided a coating consisting of two layers, the first layer being of a metal of the platinum family, ruthenium dioxide or platinum oxide and having a thickness of 0.8 to 5 mu, or of lead dioxide, in which case it has a thickness of 0.1 to 1 mm, while the second layer is of manganese dioxide and has a thickness of 1 to 2 mm, the cathode being of chromium-nickel steel containing 18 to 23 mass percent of chromium and 20 to 28 mass percent of nickel, as well as alloy additions, including copper, molybdenum, titanium, silicon and manganese.

Depending on the configuration of the basic titanium material of the anode and the available equipment for working this material, the anode may be shaped as a plate with hollows which are grooves having a depth of 0.5 to 1.5 mm and a width of 1 to 2 mm, or through holes with a diameter of 2.0 to 5.0 mm. It is also advisale that the anode should be shaped as a cylinder, whereas the hollows should be annular, helical or longitudinally extending grooves having a width of 1 to 2 mm and a depth of 0.5 to 2.0 mm.

The process of the present invention is carried out as follows.

An electrolyzer is filled with a solution of manganese sulphate containing 100 to 200 g/l of manganese sulphate and 20 to 100 g/l of sulphuric acid; the temperature of the solution is between 90° and 98° C.

The process uses a titanium anode which may be shaped as a plate or cylinder. On the anode surface there are provided hollows or indents, the inside of said hollows having a coating consisting of two layers. The hollows are produced in any known manner, for example, by milling. The total surface area of the hollows is not less than 10 percent of that of the anode. The first layer of the coating is of a metal of the platinum family, for example, platinum; it may also be of ruthenium dioxide or platinum oxide. The thickness of the first layer is 0.8 to 5 mu. The first layer also may be of lead dioxide in which case it is 0.1 to 1 mm thick. The first layer is applied inside the hollows by using any known technique. Platinum may be welded, for example, whereas ruthenium dioxide is applied through thermal decomposition of ruthenium hydroxychloride at a temperature of 450° C. Lead dioxide is extracted by electrolysis from a solution of lead nitrate. The second layer is of manganese dioxide and has a thickness of 1 to 2 mm. The second layer is applied electrolytically, manganese dioxide being extracted from an aqueous solution of manganese sulphate at a current density of 5 to 100 A/m$^2$ during 20 to 100 hours.

If the anode is plate-shaped, the hollows on its surface are either grooves with a depth of 0.5 to 1.5 mm or through holes with a diameter of 2 to 5 mm.

In anodes shaped as straight circular cylinders, the hollows are annular, helical or longitudinally extending grooves with a width of 1 to 2 mm and a depth of 0.5 to 2.0 mm.

The purpose of the first layer of the coating, consisting of a noble metal, ruthenium dioxide, platinum oxide, or lead dioxide, is to provide a conductive layer and thus rule out great ohmic resistance in the surface titanium oxide film on the titanium - manganese dioxide deposit boundary, as well to rule out high voltage across the bath during electrolysis.

In order to reduce mechanical deformation of the cathodes, the latter are manufactured from chromium-nickel steel containing 18 to 23 mass percent of chromium and 20 to 28 mass percent of nickel, as well as alloy additions, including copper, molybdenum, titanium, silicon and manganese.

The electrolysis is carried out at an anode current density of 100 to 300 A/m$^2$ and a cathode current density of 200 to 300 A/m$^2$. The reaction equation is like this:

$$MnSO_4 + 2H_2O \rightarrow MnO_2 + H_2SO_4 + H_2.$$

The sulphuric acid produced in the course of the electrolysis is neutralized with metallic manganese or manganese carbonate. The voltage across the bath is 2.3 to 3.5 V, and the duration of the electrolysis is 200 to 1,000 hours.

The electrolysis being completed, the anodes with manganese dioxide deposited on them are removed from the electrolyzer, whereupon the deposit is mechanically separated from the anode. The anodes can be re-used.

The lumps of manganese dioxide thus produced are ground into powder with particle sizes of less than 0.20 mm.

The product is then washed with two- to three-percent soda solution and dried at a temperature of 90° to 105° C.

The current efficiency is 90 to 97 percent.

The end product contains 90 to 92 mass percent of $MnO_2$.

The proposed process makes it possible to reduce the consumption of metals of the platinum family, ruthenium dioxide, platinum oxide or lead dioxide. In addition, the process of this invention makes it possible to avoid mechanical damage of the first layer of the coating, consisting of a metal of the platinum family, ruthenium dioxide, platinum oxide, or lead dioxide, while removing the anode deposit or transporting the anodes.

Equally important, the proposed cathode composition accounts for a service life of the cathodes, which is several times longer than that of conventional cathodes.

Other objects and advantages of the present invention will be more readily understood from the following examples of preferred embodiments thereof.

EXAMPLE 1

A solution containing 130 to 140 g/l of manganese sulphate and 40 to 50 g/l of sulphuric acid is subjected to electrolysis. The electrolyte temperature is 90 to 96° C. The anode is a titanium cylinder with a diameter of 20 mm and a length of 160 mm, whose surface is provided with helical grooves having a width of 1.5 mm and a depth of 2 mm. The total surface area of the grooves amounts to 20 percent of that of the anode. Into the grooves there is applied a layer of ruthenium dioxide, having a thickness of 1 mu. This layer is applied by thermally decomposing ruthenium hydroxichloride at a temperature of 450° C. Onto the layer of ruthenium dioxide there is applied a layer of electrolytic manganese dioxide extracted from an aqueous solution of manganese sulphate containing 100 g/l of manganese sulphate and 20 g/l of sulphuric acid, which is done at an anode current density of 10 A/m² and at 90° C during 100 hours. The cathode is a plate having a width of 30 mm, a thickness of 4 mm and a length of 160 mm. The cathode composition, in mass percent, is as follows:

chromium, 23
nickel, 28
carbon, 0.06
silicon, 0.8
manganese, 0.8
molybdenum, 2.5
titanium, 0.5
copper, 3.1
iron, the rest.

The anode current density is 150 A/m²; the cathode current density is 200 A/m². The voltage across the bath is 2.6 to 3.1 V. The sulphuric acid produced in the course of electrolysis is neutralized with metallic manganese. The duration of electrolysis is 350 hours. Upon the end of electrolysis, the anode with the manganese dioxide deposit is removed from the electrolyzer, after which the anode deposit is mechanically separated from the electrode. The lumps of manganese dioxide thus produced are ground into powder with a particle size of less than 0.20 mm. The powder is then washed with a soda solution and dried at a temperature of 90° to 105° C. The current efficiency is 94 percent. The mass percent composition of the end product is as follows $MnO_2$, 90.7; Fe, 0.04; Ni, absent; Cu, 0.002; Cr, 0.03; moisture, 2.7.

The ampere-hour capacity of a manganese-zinc Leclanché cell for flashlights, incorporating manganese dioxide produced in accordance with the present invention, amounts to 1.1 ampere-hours under the conditions of continuous discharge into a resistance of 3.33 ohms; when the cell is continuously discharged into a resistance of 117 ohms, its capacity amounts to 1.38 ampere-hours.

EXAMPLE 2

A solution containing 150 to 160 g/l of manganese sulphate and 20 to 25 g/l of sulphuric acid is subjected to electrolysis. The electrolyte temperature is 90° to 98° C. The anode is a titanium cylinder having a diameter of 20 mm and a length of 180 mm, on whose surface there are provided grooves with a width of 1 mm and a depth of 1.5 mm. The area of the grooves constitutes 25 percent of the total surface area of the anode. Applied into the grooves is a layer of ruthenium dioxide having a thickness of 2 mu; this is done as in Example 1. Applied onto the layer of ruthenium dioxide is a layer of electrolytic manganese dioxide extracted from an aqueous solution containing 80 g/l of manganese sulphate and 30 g/l of sulphuric acid, which is done at an anode current density of 40 A/m² and at a temperature of 90° C during 80 hours.

The cathode is a plate which is 25 mm wide, 6 mm thick and 160 mm long. The plate is of an alloy whose mass-percent composition is as follows:

chromium, 23
nickel, 28
carbon, 0.06
silicon, 0.8
manganese, 0.8
molybdenum, 2.5
titanium, 0.5
copper, 3.1
iron, the rest.

The anode current density is 250 A/m²; the cathode current density is 300 A/m². The voltage across the bath is 2.6 to 3.4 V. The sulphuric acid produced in the course of electrolysis is neutralized with manganese carbonate. The duration of electrolysis is 350 hours. When the electrolysis is completed, the anode with the manganese dioxide deposit is removed from the electrolyzer, whereupon the deposit is separated from the electrode. The lumps of manganese dioxide thus produced are ground into powder with a particle size of less than 0.20 mm. The powder is then washed with a soda solution and dried at a temperature of 90° to 105° C. The current efficiency amounts to 92 percent. The mass-percent composition of the end product is as follows: $MnO_2$, 90.2; Fe, 0.02; Ni, absent; Cu, 0.002; Cr, 0.04; moisture, 2.1.

The ampere-hour capacity of a manganese-zinc Leclanché cell for flashlights, incorporating manganese dioxide of the above composition, amounts to 1.02 ampere-hour under the conditions of continuous discharge into a resistance of 3.33 ohms; when continuously discharged into a resistance of 117 ohms, the cell's capacity amounts to 1.28 ampere-hour.

EXAMPLE 3

The process is carried out as in Example 1, but the hollows in this case are helical grooves.

The composition of the end product, in terms of mass percent, is as follows: $MnO_2$, 90.4; Fe, 0.03; Ni, absent; Cu, 0.003; Cr, 0.04; moisture, 2.3.

EXAMPLE 4

A solution containing 140 to 150 g/l of manganese sulphate and 30 to 35 g/l of sulphuric acid is subjected to electrolysis. The temperature of the electrolyte is 90° to 96° C. The anode is a titanium plate having a length of 160 mm, a width of 90 mm and a thickness of 8 mm, on whose surface there are provided grooves with a depth of 1 mm and a width of 1.5 mm. The area of the grooves amounts to 10 percent of the total surface area of the anode. Inside the grooves there are spot-welded pieces of platinum foil with a thickness of 20 mu. The second layer of the coating is of electrolytic manganese dioxide with a thickness of 1 mm, which is applied as in Example 1. The cathode is that of Example 1.

The anode current density is 300 A/m²; the cathode current density is 200 A/m². The voltage across the bath is 3.0 to 3.5 V. The sulphuric acid produced in the course of electrolysis is neutralized with metallic manganese. The duration of electrolysis is 350 hours. The manganese dioxide deposited on the anode is treated as in Example 1.

The composition of the end product, in mass percent, is as follows: $MnO_2$, 90.5; Fe, 0.05; Ni, absent; Cu, 0.003; Cr, 0.04; moisture, 2.6.

The capacity of a manganese-zinc Lechanche çell for flashlights, incorporating manganese dioxide of the above composition, amounts to 1.04 ampere-hour under the conditions of continuous discharge into a resistance of 3.33 ohms; when continuously discharged into a resistance of 117 ohms, the cell's capacity amounts to 1.26 ampere-hour.

EXAMPLE 5

A solution containing 125 to 135 g/l of manganese sulphate and 40 to 45 g/l of sulphuric acid is subjected to electrolysis. The temperature of the electrolyte is 90° to 95° C. The anode is a titanium plate having a length of 160 mm, a width of 90 mm and a thickness of 3 mm. The plate is provided with through holes, into which there is applied a layer of platinum chloride acid having a concentration of 130 g/l. The layer is heated to a temperature of 450° C during 20 minutes. The platinum oxide layer thus produced is 2 mu thick. Onto this layer there is electrolytically applied a layer of manganese dioxide extracted from a solution containing 60 g/l of manganese sulphate and 40 g/l of sulphuric acid, which is done at an anode current density of 100 A/m² during 20 hours.

The area of the protective layer amounts to 15 percent of the total surface area of the anode. The cathode is of an alloy whose composition, in terms of mass percent, is as follows:

chromium, 19
nickel, 21
carbon, 0.05
silicon, 2.5
manganese, 0.8
molybdenum, 3.0
titanium, 0.4
copper, 2.3
iron, the rest.

The anode current density is 200 A/m²; the cathode current density is 250 A/m². The voltage across the bath is 2.8 to 3.1 V. The sulphuric acid produced in the course of electrolysis is neutralized with manganese carbonate. The duration of electrolysis is 350 hours. The manganese dioxide deposited on the anode is treated as in Example 1.

The composition of the electrolytic manganese dioxide thus produced, in terms of mass percent, is as follows: $MnO_2$, 90.7; Fe, 0.03; Ni, absent; Cu, 0.002; Cr, 0.04; moisture, 2.8.

The capacity of a manganese-zinc Leclanche cell for flashlights, incorporating manganese dioxide of the above composition, amounts to 1,06 ampere-hour under the conditions of continuous discharge into a resistance of 3.33 ohms; when discharged into a resistance of 117 ohms, the cell's capacity is 1.28 ampere-hour.

EXAMPLE 6

A solution containing 120 to 130 g/l of manganese sulphate and 50 to 60 g/l of sulphuric acid is subjected to electrolysis. The temperature of the solution is 90° to 96° C. The anode is a titanium cylinder having a diameter of 20 mm and a length of 170 mm, whereon there are provided helical grooves 1.5 mm wide and 1.5 mm deep. The area of the grooves amounts to 30 percent of the total surface area of the anode. Into the grooves there is applied a layer of lead dioxide which is electrolyzed from an aqueous solution containing 350 g/l of $Pb(NO_3)_2$ and 5 g/l of $Cu(NO_3)_2$. The process is carried out during 10 hours at an anode current density increased stepwise from 1 A/m² to 20 A/m². The temperature of the electrolyte is 70° C. Onto the layer of lead dioxide there is electrolytically applied a layer of manganese dioxide which is extracted from an aqueous solution containing 100 g/l of manganese sulphate and 30 g/l of sulphuric acid during 40 hours at an anode current density of 30 A/m² and a temperature of 90° C.

The cathode is a plate 25 mm wide, 6 mm thick and 160 mm long. The plate is of an alloy of the following composition in mass percent:

chromium, 23
nickel, 28
carbon, 0.06
silicon, 0.8
manganese, 0.8
molybdenum, 2.5
titanium, 0.5
copper, 3.1
iron, the rest.

The anode current density is 150 A/m². The cathode current density is 250 A/m². Voltage across the bath is 2.7 to 3.5 V. Sulphuric acid produced in the course of electrolysis is neutralized by metallic manganese.

The duration of electrolysis is 400 hours.

The anode deposit of manganese dioxide is processed as in Example 1. The electrolytic manganese dioxide thus produced contains in mass percent: $MnO_2$, 91.4; Fe, 0.02; Ni, absent; Cu, 0.001; Cr, 0.03; Pb, 0.02; moisture, 2.1.

The capacity of a manganese-zinc Leclanche cell for flashlights, incorporating manganese dioxide of the above composition, amounts to 1.11 ampere-hour under the conditions of continuous discharge into a resistance of 3.33 ohms; when discharged into a resistance of 117 ohms, the cell's capacity is 1.39 ampere-hour.

What is claimed is:

1. An electrochemical process for producing manganese dioxide by electrolyzing a solution containing 100 to 200 g/l of manganese sulphate and 200 to 100 g/l of sulphuric acid, the temperature of the solution being 90° to 98° C, the electrolysis being carried out at an anode current density of 100 to 300 A/m² with the use of a titanium anode on whose surface there are provided uniformly spaced hollows whose total surface area is not less than 10 percent of that of the anode, said hollows being provided with a coating consisting of two layers, the first being of a metal of the platinum family, ruthenium dioxide or platinum oxide and having a thickness of 0.8 to 5 mu, or of lead dioxide, in which case it has a thickness of 0.1 to 1 mm, whereas the second layer is of manganese dioxide and has a thickness of 1 to 2 mm, the cathode being of chromium-nickel steel containing 18 to 23 mass percent of chromium, 20 to 28 mass percent of nickel, and alloy additions including copper, molybdenum, titanium, silicon and manganese.

2. A process as claimed in claim 1, whereby the anode is a plate provided with grooves having a depth of 0.5 to 1.5 mm and a width of 1 to 2 mm.

3. A process as claimed in claim 1, whereby the anode is a plate provided with through holes having a diameter of 2.0 to 5.0 mm.

4. A process as claimed in claim 1, whereby the anode is shaped as a cylinder and provided with annular grooves having a width of 1 to 2 mm and a depth of 0.5 to 2.0 mm.

5. A process as claimed in claim 1, whereby the anode is shaped as a cylinder and provided with helical grooves having a width of 1 to 2 mm and a depth of 0.5 to 2.0 mm.

6. A process as claimed in claim 1, whereby the anode is shaped as a cylinder and provided with longitudinally extending grooves having a width of 1 to 2 mm and a depth of 0.5 to 2.0 mm.

* * * * *